US006505981B1

(12) United States Patent
Takami et al.

(10) Patent No.: US 6,505,981 B1
(45) Date of Patent: Jan. 14, 2003

(54) PRINTER WITH LABEL SEPARATOR

(75) Inventors: Toru Takami, Nagano (JP); Toshihiro Tsukada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/568,702

(22) Filed: May 11, 2000

Related U.S. Application Data

(63) Continuation of application No. 09/169,050, filed on Oct. 9, 1998, now Pat. No. 6,092,945.

(51) Int. Cl.[7] ..... B41J 11/48; B41J 11/26; B41J 2/315

(52) U.S. Cl. ..... 400/602; 400/617; 400/120.16; 400/120.17

(58) Field of Search ..... 400/582, 690.4, 400/611, 617, 82, 103, 58, 655, 660, 649, 120.16, 120.17; 101/288

(56) References Cited

U.S. PATENT DOCUMENTS 5,045,145 A * 9/1991 Becker ..... 156/384
5,188,029 A * 2/1993 Sugimoto et al. ..... 101/288
5,229,587 A 7/1993 Kimura et al.
5,672,020 A * 9/1997 Leonard et al. ..... 400/690.4
6,068,419 A * 5/2000 Shiozaki et al. ..... 400/582

FOREIGN PATENT DOCUMENTS

DE 32 46 563 A 6/1984
EP 0 764 585 A 3/1999
JP 06 166227 A 6/1994

* cited by examiner

*Primary Examiner*—Andrew H. Hirshfeld
*Assistant Examiner*—Marvin P. Crenshaw
(74) *Attorney, Agent, or Firm*—Nixon & Vanderhye P.C.

(57) ABSTRACT

Setting plain paper in a printer which can print on plain paper and a label paper is facilitated using a printer capable of printing a recording medium including a base sheet and at least one label sheet detachably adhered thereon. The printer includes a print head and platen opposing to each other for printing the recording medium. A first printer housing houses the platen, and a second printer housing movably connected to the first housing houses the print head. The printer also includes an ejection port, defined at the border of the first and second printer housings, from which the recording medium is ejected after printed by the print head and platen, and a separator for curving the base sheet ejected from the ejection port to separate the leading edge of the label sheet from the base sheet.

15 Claims, 6 Drawing Sheets

PRINTER WITH LABEL SEPARATOR

CROSS-REFERENCE TO RELATED APPLICATIONS

This application is a continuation of Serial No. 09/169050, filed Oct. 9, 1998, now U.S. Pat. No. 6,092,945.

BACKGROUND OF THE INVENTION

1. Field of the Invention

The present invention relates to a printer using thermal recording technology, for example, and, particularly, relates to a printer which can print on both a recording sheet for a label on a base sheet (hereinafter called label paper) and normal recording paper (hereinafter called plain paper) as a recording medium.

2. Related Art

Heretofore, work for sticking on commodities a label on which a bar code showing the price of a product, a destination of delivery and so on are printed, is performed in a store, a physical distribution center and others. Recently, a portable small-sized printer for issuing such a label has been proposed.

FIG. 7 is a schematic drawing showing the internal constitution of a conventional type printer for issuing a label.

As shown in FIG. 7, roll label paper 103 in which plural labels 102 are stuck on a base sheet 101 is loaded into a printer 100. A thermal head 106 is attached to a printer cover 105 which can be opened or closed against a printer body 104. The printer 100 is constituted so that the thermal head 106 presses the label paper 103 against a platen roller 107 when the printer cover 105 is closed, and predetermined printing is performed on the label 102.

A contact member 108 is provided over the platen roller 107 and the base sheet 101 of the label paper 103 is bent when pressed against the platen roller 107 by a pressing roller 109 provided on the end of the printer cover 105. Owing to such constitution, when the label paper 103 is fed after printing, the base sheet 101 and the label 102 are separated because of the rigidity of the label 102 and the label 102 is ejected from an ejection port 110 provided in the printer cover 105. In the meantime, the base sheet 101 of the label paper 103 is ejected from another ejection port formed at the front of the printer body 104.

The printer 100 can also print on rolled plain paper not shown instead of the above label paper 103, and in that case, printed plain paper is ejected from the ejection port 110 of the printer cover 105.

However, the conventional type printer 100 constituted as described above has the following problems.

That is, a printer provided with a mechanism for separating the above label has a problem that when plain paper is set, the leading end of the plain paper is required to be passed through the ejection port 110 of the printer cover 105 and the work is very troublesome and causes waste of time in setting the plain paper roll.

SUMMARY OF THE INVENTION

An object of the present invention is to solve such problems of prior art and to facilitate setting of plain paper as well as label paper in a printer which can print on both plain paper and label paper.

According to an aspect of the present invention, there is provided a printer capable of printing a recording medium including a base sheet and at least one label sheet detachably adhered thereon, comprising: a print head and platen opposing each other for printing the recording medium; a printer housing for housing said print head and platen; an ejection port, provided on said printer housing, from which the recording medium is ejected after having been printed by said print head and platen; and a separator for curving the base sheet ejected from said ejection port to separate the leading edge of the label sheet from the base sheet.

According to the present invention, a transportation path is provided through which the base sheet is curved by the separator after the recording medium printed by the print head and the platen is ejected from the ejection port. Thus, the plain paper which does not require use of the separator can be directly received from the ejection port. Thus, the plain paper can be set more easily without threading the separator.

In this case, it is preferable to employ a contact member arranged on the ejection port and at a platen side of the ejection port and a guide member for guiding the base sheet downstream of said contact member to be curved by said contact member.

In this situation, it is preferable that the guide member is movably provided so as to be released from the separating position where the guide member, in cooperation with the contact member, curves the recording medium to separate the leading edge of the label sheet.

When a recording medium is set, the separator is arranged in a predetermined standby position with the print head and the platen arranged opposite, and the label paper is carried and then positioned. After then, when the guide member is moved to a pressing position, the base sheet of the label paper as the recording medium is curved by the contact member. Therefore, if the label paper is further carried in the above arrangement, the leading edge of the label sheet is naturally separated from the base sheet because of the rigidity of the label sheet.

Further, it is preferable to provide the guide member with a roller for transporting the base sheet. Thus, the function of the guide member namely that the base sheet is transported in a curved manner by means of the contact member is facilitated.

Moreover, in this condition, it is preferable to provide a detector for detecting the label sheet and a driver for moving the guide member, such that the driver moves the guide member to the separating position in accordance with detection of the label sheet by the detector.

According to the present invention, the recording medium set up operation is performed automatically and smoothly. Thus facilitating the operability or the printer.

According to another aspect of the present invention, there is provided a printer capable of printing a recording medium including a base sheet and at least one label sheet detachably adhered thereon comprising: a print head and platen opposing each other for printing the recording medium; a first printer housing for housing the platen; a second printer housing movably connected to the first printer housing for housing the print head; an ejection port, defined at the border of the first and second printer housings, from which the recording medium is ejected after having been printed by the print head and platen; and a separator for curving the base sheet ejected from the ejection port to separate the leading edge of the label sheet from the base sheet.

In this case, it is preferable to provide the separator on the first printer housing. And, it is further preferable that the separator comprises a contact member arranged on the ejection port and at platen side of said ejection port and a guide member for guiding the base sheet downstream of said contact member to be curved by said contact member. The contact member is preferably arranged on the first printer housing, and the guide member is movably mounted on the second housing. It is also effective that the above platen is provided on one printer housing, while the above print head and a head controller for controlling the operation of the print head are provided inside the other housing.

As a result, the print head and the head controller are arranged inside the same printer housing, wiring can be completed without passing a movable part and hereby, the wiring of the print head can be facilitated. In addition, if the print head and the head controller are arranged closely, wiring for the print head can be shortened and, hereby, the effect of electric noise upon the print head can be reduced and the cost of the wiring for the head can also be reduced.

Further, according to one embodiment of the present invention, since a print head and a head controller can be connected with wiring extended inside a main printer housing and in addition, wiring for the head can be constituted without passing a movable part, a destruction of the wiring to the print head due to a frequent bending can be avoided.

According to another embodiment of the present invention, since the print head is provided inside the main printer housing and foreign matter such as dust hardly invades in its driving part, there is also a merit that the print head can be kept durable.

It is also effective that a print head is provided on one printer housing, while a platen also serving as a transportation roller and a driving mechanism for applying driving force thereto are provided on the other printer housing and a printer is constituted so that recording paper is carried by driving the platen.

In this case, as the platen and its driving mechanism are provided on the same main printer housing, driving force can be applied to the platen while keeping the platen and the driving mechanism in the same positional relationship, as a result of which the platen can be always stably driven and thus recording paper can be precisely transported.

Also, according to the present invention, since the opening and closing of a printer cover has no effect upon a transmission of a driving mechanism, recording paper can be precisely transported in a long term.

DETAILED DESCRIPTION OF THE PREFERRED EMBODIMENTS

Figure 1:
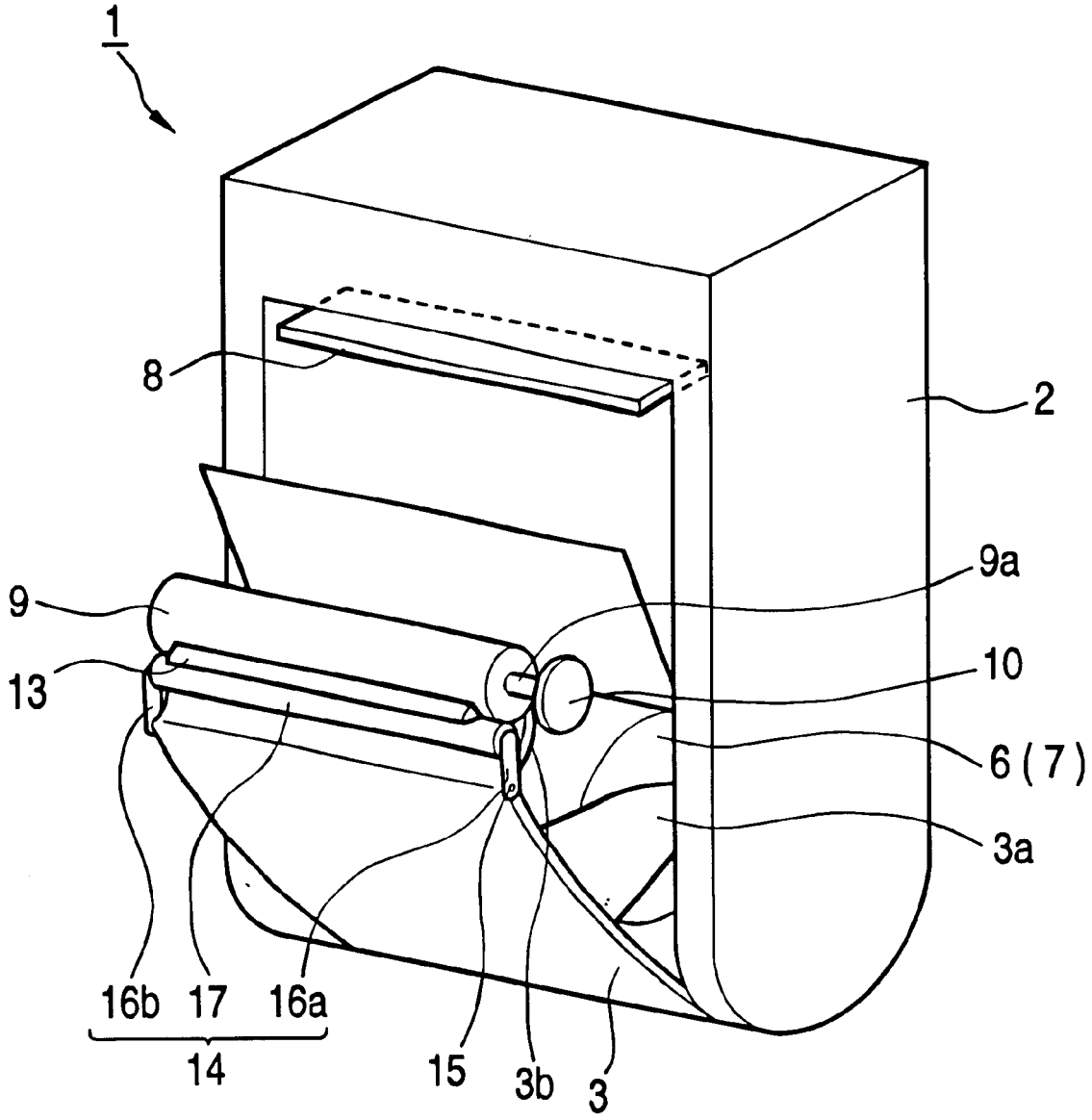
FIG. 1 is a perspective drawing showing the appearance of a printer according to a first embodiment of the present invention.

Referring to the drawings, the preferred embodiments of a printer according to the present invention will be described in detail below.

First Embodiment

Figure 2:
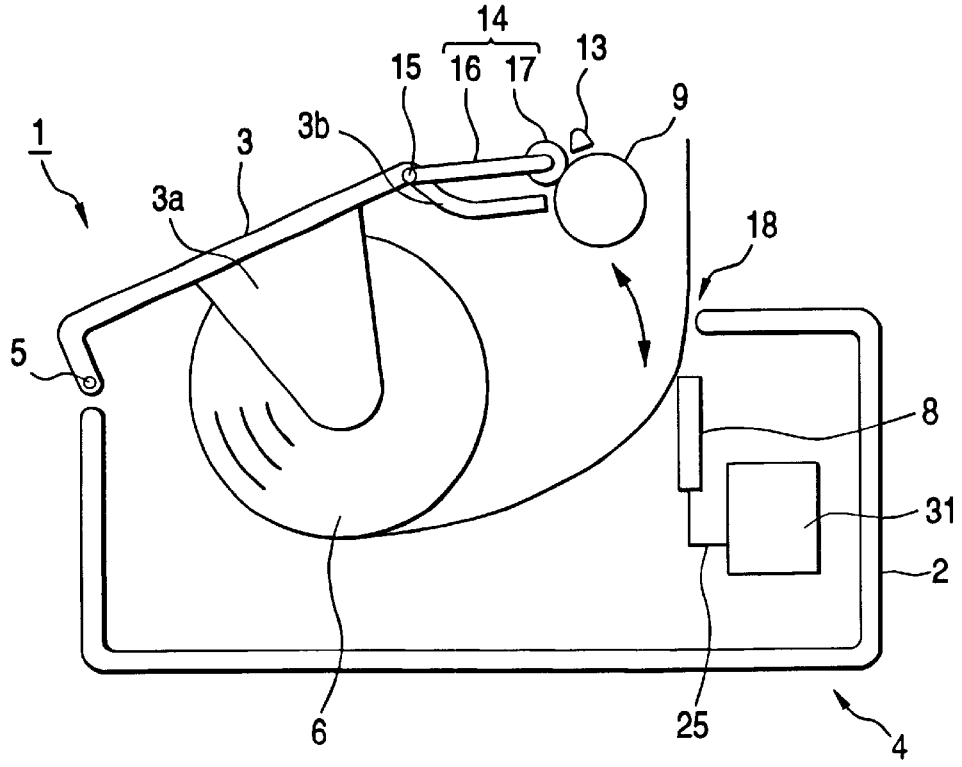
FIG. 2(*a*) is a schematic drawing showing the internal constitution of the printer according to the first embodiment in setting the plain paper, FIG. 2(*b*) is a schematic drawing showing the internal constitution of the printer according to the first embodiment in setting the label paper.
Figure 2:
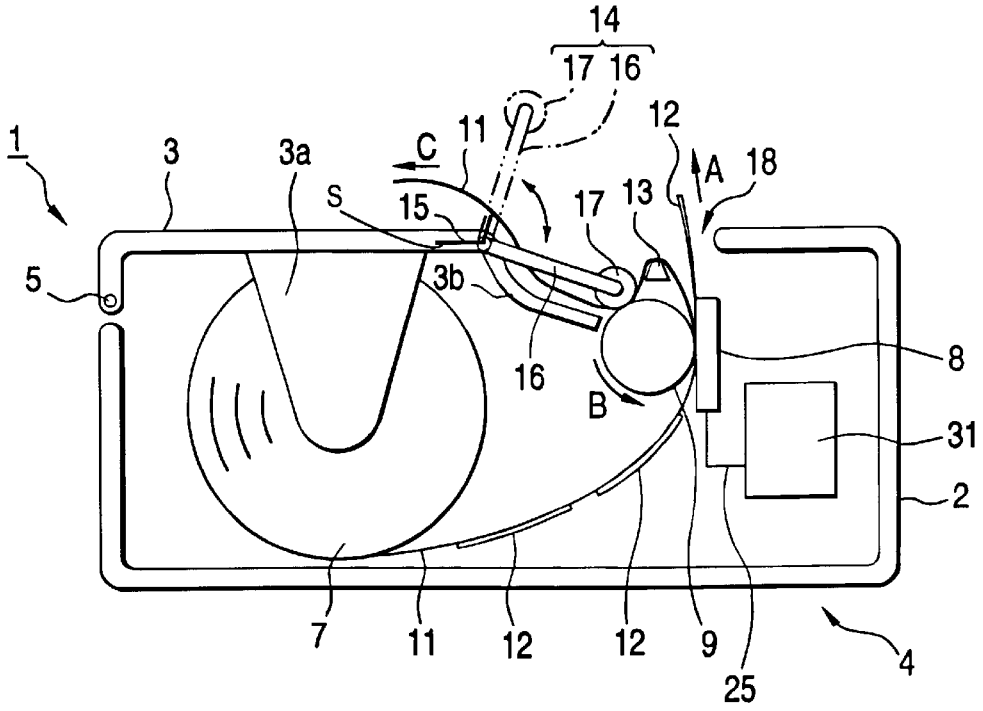

FIG. 1 is a perspective drawing showing the appearance of a printer according to a first embodiment of the present invention, FIG. 2(*a*) is a schematic drawing showing the internal constitution of the printer in this embodiment and shows a case that plain paper is set, FIG. 2(*b*) is a schematic drawing showing the internal constitution of the printer in this embodiment and shows a case that label paper is set.

As shown in FIG. 1, in the printer 1 of this embodiment, the body 4 is composed of a main housing 2 and a cover housing 3.

Note that in the present invention, a first printer housing refers to a printer housing for supporting a platen roller 9, and a second printer housing refers to another printer housing for supporting a print head 8. Therefore, in this embodiment, the cover housing 3 corresponds to the first printer housing, and the main housing 2 corresponds to the second printer housing.

The cover housing 3 is pivotally attached to the main housing 2 by a pivot 5 so that the cover housing 3 can be turned. A supporting part 3*a* for rotatably supporting roll recording paper is provided on the inner side of the cover housing 3. The printer in this embodiment can print on both plain paper 6 and label paper 7 as recording paper.

As shown in FIGS. 2(*a*) and 2(*b*), a thermal head (a print head) 8 is provided on the front side of the main housing 2 and is connected o a circuit board 31 via a lead wire (wiring) 25. The circuit board 31 functions as a head controller for controlling the operation of the thermal head 8, and in this embodiment, the circuit board 31 is arranged in the vicinity of the front side of the main housing 2.

A platen roller 9 (a platen) made of rubber, for example, is attached to the front end of the cover housing 3 and the platen roller 9 is pressed onto the thermal head 8 when the cover housing 3 is closed. A gear 10 is fixed to the roller shaft 9*a* of the platen roller 9 and constituted so that the driving force of a driving motor not shown is transmitted to the gear 10.

As shown in FIG. 2(*b*), label paper 7 as a recording medium is constituted by sticking plural labels 12 which are label sheets on a pasteboard 11 which is base sheet. A contact member 13 for curving the pasteboard 11 of label paper 7 is arranged in the vicinity of the upper side of the platen roller 9. As shown in FIG. 1, the contact member 13 is composed of a long member extended in parallel with the platen roller 9 and its cross section is approximately triangular.

A guide portion 3*b* is formed at the front end of the cover housing 3 and curved toward the main housing 2. The guide portion 3*b* is provided to guide the separated pasteboard 11 of label paper 7 to go over the cover housing 3.

A guide member 14 for pressing the pasteboard 11 of label paper 7 upon the contact member 13 and separating it is provided on the cover housing 3. Note that, in the present embodiment, the term "separator" refers to a combination of the guide member 14 and contact member 13. The guide member 14 is attached to the side ends and on the front of the cover housing 3 so that a pair of arms 16 (16*a* and 16*b*) can be turned around a pivot 15 and further, a pressing roller 17 which can be turned for separating the label 12 from the pasteboard 11 is rotatably supported between the ends of both arms 16*a* and 16*b*. The pressing roller 17 is made by an elastic material such as rubber and arranged in parallel with the platen roller 9.

As shown in FIG. 2(*b*), the guide member 14 is constituted so that the pressing roller 17 can be turned between a position (a standby position) shown by an alternate long and two short dashes line above the contact member 13 which is a position off a predetermined recording paper transporting path formed by the separator 13, 14, and a position (a separating position) shown by a solid line in which the pressing roller 17 is pressed upon the platen roller 9 usually via the base sheet in a state in which the cover housing 3 is closed, that is, in a state in which the thermal head 8 and the platen roller 9 are arranged opposite to each other ready for printing. The pressing roller 17 is pressed upon the platen roller 9 by a spring member S.

If plain paper 6 is set and printed in this embodiment constituted as described above, the cover housing 3 is opened as shown in FIG. 2(*a*) and plain paper 6 is loaded into a supporting part 3*a*. In this case, the plain paper 6 is pulled out from an ejection port 18 in the upper part of the main housing 2. When the cover housing 3 is closed, the thermal head 8 presses the plain paper 6 against the platen roller 9, and setting is completed. After then, printing is performed, rotating the platen roller 9 and ejecting the plain paper 6.

For setting and printing label paper 7 in this embodiment, the label paper 7 is loaded into the supporting part 3*a* of the cover housing 3 as in the case of plain paper 6, and the cover housing 3 is closed with the end of the pasteboard 11 pulled out of the ejection port 18. As shown in FIG. 2(*b*), the pressing roller 17 is moved to a position shown by the alternate long and two short dashes line after having been lifted by fingers for example, and the end of the pasteboard 11 is inserted between the pressing roller 17 and the contact member 13. The pasteboard 11 of the label paper 7 is then pressed on the platen roller 9 as shown by the solid line by releasing finger force lifting the pressing roller 17.

After then, the thermal head 8 is driven, rotating the platen roller 9 counterclockwise (in a direction shown by an arrow B) and carrying the label paper 7 in the same direction to perform predetermined printing on the label 12. For the carried label paper 7, the pasteboard 11 is curved upward by the contact member 13 into a convex shape as shown in FIG. 2(*b*), while since the label 12 is hardly curved because of its rigidity, the pasteboard 11 and the leading edge of the label 12 are separated.

The printed label 12 is ejected in a direction shown by an arrow A from the ejection port 18 by such an operation, while the pasteboard 11 can be ejected in a direction shown by an arrow C above the cover housing 3.

As described above, according to the present invention, as the guide member 14 is arranged in a position off the transportation path in a state in which the thermal head 8 and the platen roller 9 are arranged opposite to each other and nothing interrupts plain paper 6 in the path, plain paper 6 can be simply and securely set and paper feed can be smoothed.

On the other hand, when label paper 7 is set, the pasteboard 11 and the label 12 can be fed in a state in which they can be readily separated because the guide member 14 is moved to the separating position after the guide member 14 has been once arranged in a standby position with the thermal head 8 and the platen roller 9 arranged opposite pressing the label paper therebetween.

Also, in this embodiment, as the thermal head 8 and the circuit board 31 are arranged inside the main housing 2, the lead wire 25 can be wired without passing a movable part and hereby, wiring processing for the thermal head 8 can be facilitated.

Particularly in this embodiment, as the thermal head 8 and the circuit board 31 are arranged closely, the lead wire 25 can be shortened, hereby, the thermal head can be constituted so that electric noise hardly has any effect upon the thermal head 8 and the cost of wiring for the print head can be reduced.

Further, according to this embodiment, as the thermal head 8 and the circuit board 31 can be connected via the lead wire 25 inside the main housing 2 and, in addition, the lead wire 25 does not pass to the movable part, the lead wire 25 is prevented from being disconnected due to being frequently bent.

Also, in this embodiment, as the thermal head 8 is provided inside the main housing 2 and any foreign matter such as dust hardly invades into the driving part, there is a merit that the thermal head 8 is kept durable.

Second Embodiment

Figure 3:
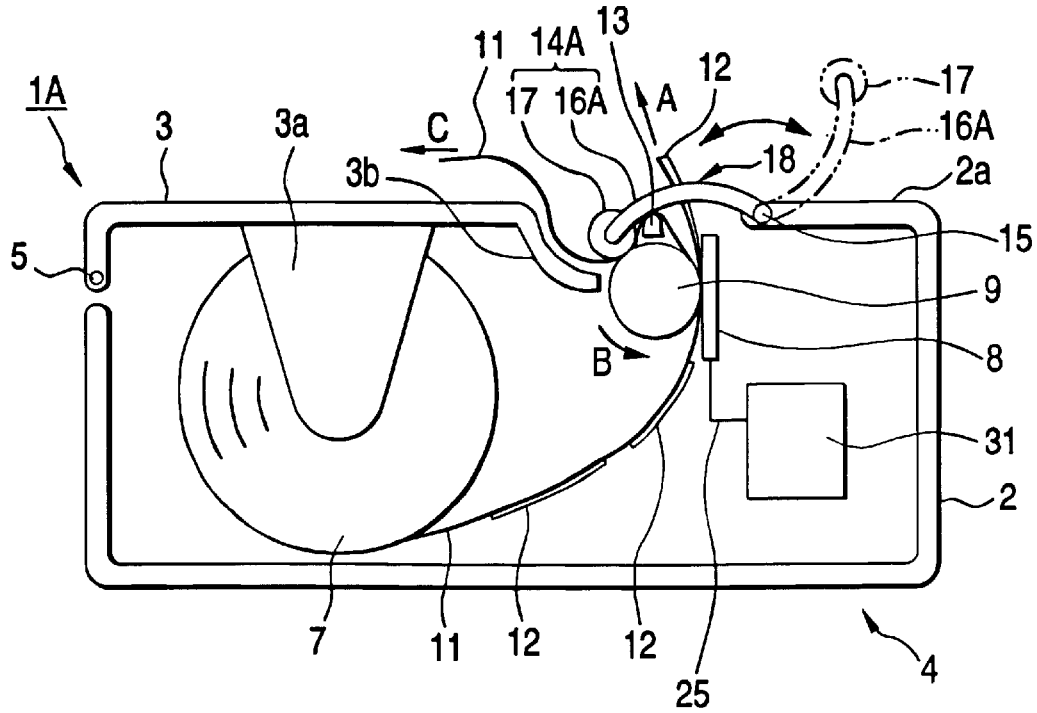
FIG. 3 is a schematic drawing showing the internal constitution of a printer according to a second embodiment of the present invention.

FIG. 3 is a schematic drawing showing the internal constitution of a second embodiment of a printer according to the present invention, wherein the same reference numbers are used to denote parts corresponding to those of the above embodiment and another description of those parts is omitted.

As shown in FIG. 3, in this embodiment, a guide member 14A which can be turned is provided on the side of a main housing 2. An arm 16A for holding a pressing roller is attached to both sides of the upper part 2*a* on the front side of the main housing 2 so that the arm can be turned around the pivot 15. The guide member 14A is constituted so that a pressing roller 17 can be turned between a position (a standby position) shown by an alternate long and two short dashes line and over the upper part 2*a* on the front side of the main housing 2 and a position (a separating position) shown by a solid line and pressed upon the platen roller 9. In addition, the guide member 14A is constituted so that a helical tension spring not shown of which one end is attached to the arm 16A, presses the upper part 2*a* on the front side in the standby position and presses the platen roller 9 in the pressing position.

FIG. 3 shows the case that label paper 7 is set while a case that plain paper is set is omitted.

In case plain paper is set and printing is performed in this embodiment constituted as described above, the pressing roller 17 of the guide member 14A is lifted by fingers for example and is moved to the standby position shown by the alternate long and two short dashes line in FIG. 3. Next, when the cover housing 3 is opened, plain paper is loaded into the supporting part 3*a* and the cover housing 3 is closed with the end of the plain paper pulled out upward in a direction shown by an arrow A from the ejection port 18, the setting of the plain paper is completed. After then, the thermal head 8 is driven, rotating the platen roller 9, moving and ejecting the plain paper 6 and desired printing is performed on the plain paper 6.

In case label paper 7 is set and printing is performed in this embodiment, the pressing roller 17 of the guide member 14A is moved to the standby position shown by the alternate long and two short dashes line in FIG. 3, the cover housing 3 is opened and label paper 7 is loaded into the supporting part 3*a* as in the case of plain paper 6. Next, the cover housing 3 is closed with the end of a pasteboard 11 pulled out upward.

As shown by the solid line in FIG. 3, the pressing roller 17 of the guide member 14A is rotated to the separating position and the pasteboard 11 of the label paper 7 is pressed upon the platen roller 9.

After then, the pasteboard 11 and the leading edge of a label 12 are separated as in the above embodiment by driving the thermal head 8, rotating the platen roller 9 counterclockwise (in a direction shown by an arrow B) and carrying the label paper 7 in the same direction and by performing desired printing on the label 12.

By such operation, the printed label 12 is ejected in the direction shown by the arrow A from an ejection port 18, while the pasteboard 11 can be ejected in a direction shown by an arrow C on the cover housing 3.

As described above, paper feed can be smoothed also in this embodiment when plain paper 6 is set and in case label paper 7 is set, the pasteboard 11 and the label 12 can be readily separated.

In this embodiment, as in the above embodiment, the pressing roller 17 may be also pressed upon the platen roller 9 by a spring member not shown in the figures. Since the other constitution, action and effect are the same as in the above embodiment, the detailed description is omitted.

Third Embodiment

Figure 4:
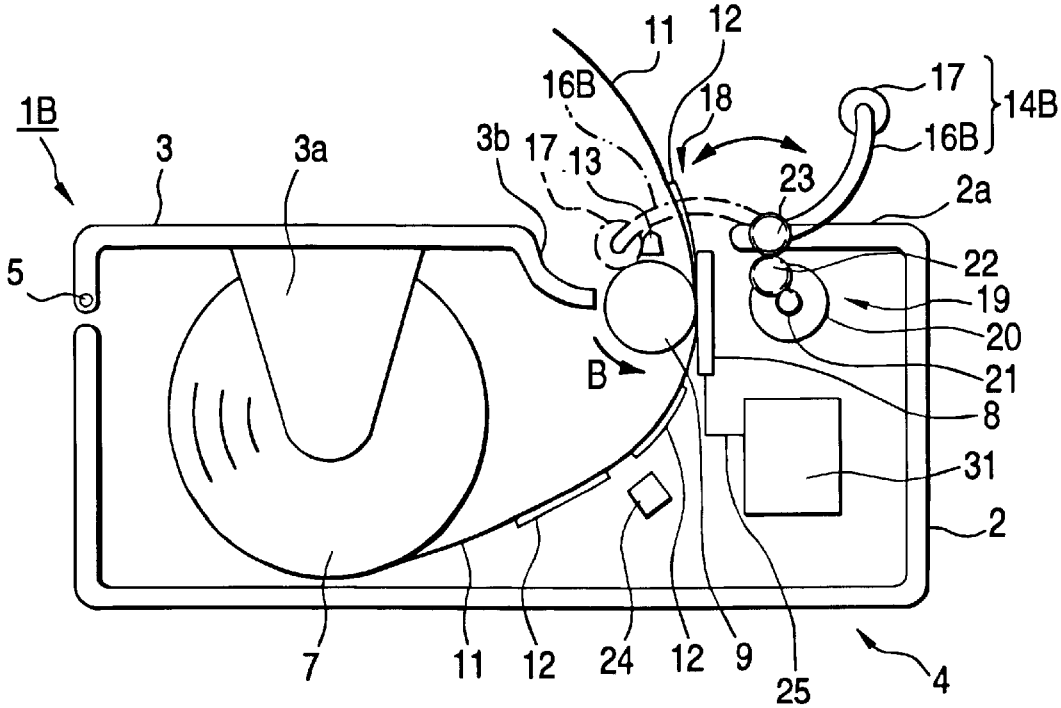
FIG. 4 is a schematic drawing showing the internal constitution of a printer according to a third embodiment of the present invention.

FIG. 4 is a schematic drawing showing the internal constitution of a third embodiment of the printer according to the present invention, wherein the same reference numbers are used to denote parts corresponding to those in the above embodiment and the description of those parts is omitted.

A guide member 14B which can be turned is provided on a printer 1B of this embodiment on the side of a main housing 2 as in the second embodiment, however, this embodiment is different from the second embodiment in that a driving mechanism 19 for turning the guide member 14B is provided.

As shown in FIG. 4, the guide member 14B of the printer 1B according to this embodiment is provided with the same constitution as the constitution without a tension spring in the second embodiment and is attached to the end of the upper part 2*a* on the front side of the main housing 2 as in the second embodiment. The driving mechanism 19 is provided immediately under the upper part 2*a* on the front side of the main housing 2. The driving mechanism 19 is provided with a driving motor 20 driven according to a signal from a CPU not shown and is constituted so that the torque of the driving motor 20 is transmitted to the arm 16B of the guide member 14B via a gear 21 fixed to the rotating shaft and a gear train 22 15 and 23. Owing to such constitution, the pressing roller 17 of the guide member 14B can be turned between a position (a standby position) shown by a solid line and over the upper part 2*a* on the front side of the main housing 2 and a position (a separating position) shown by an alternate long and two short dashes line and pressed upon the platen roller 9 in a state in which a cover housing 3 is closed.

Also as shown in FIG. 4, in this embodiment, a detector 24 for detecting the type of loaded recording paper is provided. For the detector 24, one composed of a reflection type photo sensor, for example, is used and the detector 24 is connected to the above mentioned CPU. A discrimination circuit for discriminating the type of recording paper based upon the change in the quantity of light incident on the detector 24 is constituted. Further in detail, since with the label paper the reflected light of a pasteboard 11 and that of a label 12 are different from each other, recording paper is judged to be label paper in case reflected light periodically varies in quantity when the recording paper is fed, and is judged to be plain paper in case reflected light remains unchanged in quantity. Alternatively, each reference value of the reflected light of plain paper and label paper is set and they may be also distinguished based upon such reference values.

When the detector 24 is set on the side of a label, there is also the effect that the position of a label 12 can be detected by judging the quantity of the reflected light of the label 12 and the pasteboard 11 as described above and printing in a desired position of the label 12 is enabled.

In this embodiment provided with such constitution, in case plain paper 6 is printed, that is, if it is judged that plain paper 6 is loaded, the pressing roller 17 of the guide member 14B is arranged in the standby position shown by the solid line in FIG. 4 according to a signal from the above mentioned CPU and predetermined printing is performed according to the same procedure as in the second embodiment.

On the other hand, if it is judged that label paper is loaded, the driving motor 20 is driven according to a signal from the above CPU, the arm 16B of the guide member 14B is rotated from the standby position shown by the solid line in FIG. 4 to the separating position shown by the alternate long and two short dashes line in FIG. 4 and the pasteboard 11 of the label paper 7 is pressed upon the platen roller 9. Predetermined printing is performed according to the same procedure as in the second embodiment.

As described above, according to this embodiment, since printing is enabled merely by loading plain paper 6 or label paper 7 into the supporting part 3*a* of the cover housing 3 and closing the cover housing 3, in addition to the same effect achieved in the above embodiments, setting of recording paper is further facilitated and the operability of the printer can be enhanced even more.

Also, according to this embodiment, since pressure of the pressing roller 17 upon the platen roller 9 can be finely controlled, there is a merit that the pasteboard 11 of label paper 7 can be more smoothly ejected. As the other constitution, action and effect are the same as in the above embodiments, the detailed description is omitted.

Fourth Embodiment

Figure 5:
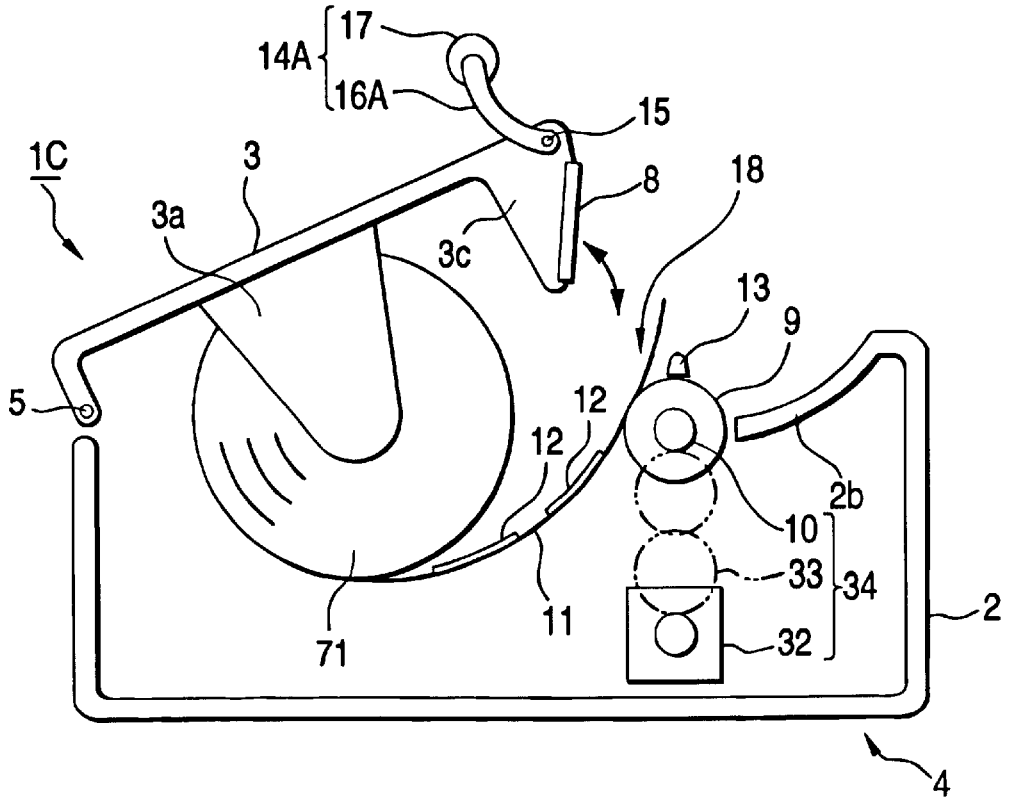
FIG. 5(*a*) is a schematic drawing showing the internal constitution of a fourth embodiment of the printer according to the present invention in setting the label paper with the second printer housing opened, FIG. 5(*b*) is a schematic drawing showing the internal constitution of the fourth embodiment in setting the label paper with the second printer housing closed.
Figure 5:
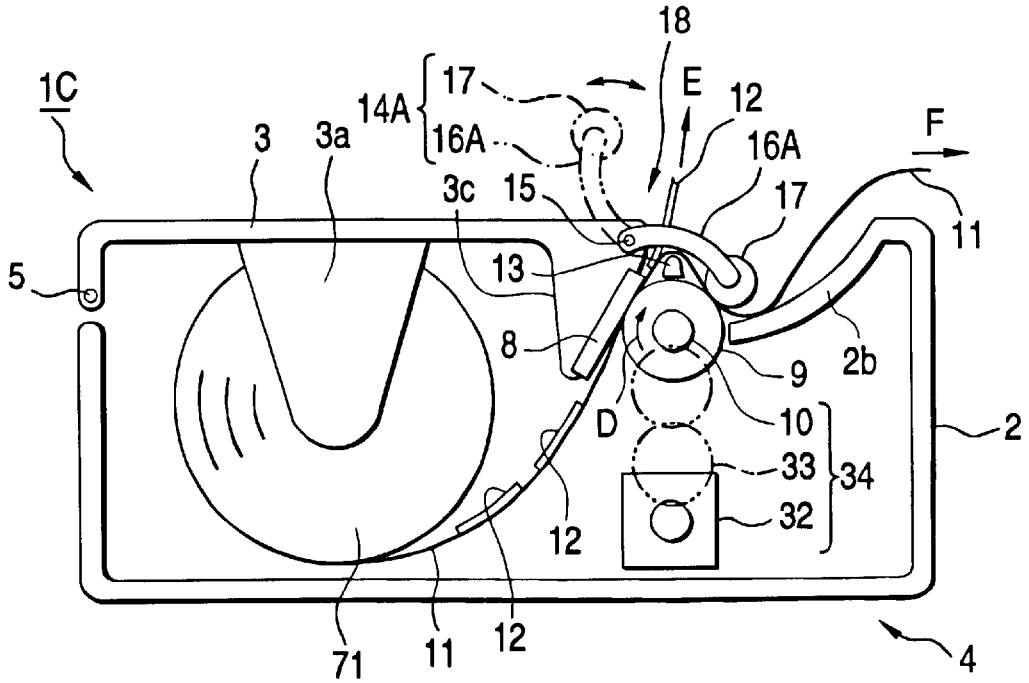

FIGS. 5(*a*) and 5(*b*) are schematic drawings showing the internal constitution of a fourth embodiment of the printer according to the present invention, FIG. 5(*a*) shows a state in which a cover housing is open in case label paper is set and FIG. 5(*b*) shows a state in which the cover housing 3 is closed in case label paper is set. The same reference numbers are used to denote parts corresponding to those in the above embodiments and the description is omitted.

As shown in FIGS. 5(*a*) and 5(*b*), in a printer 1C according to this embodiment, a print head is provided on the side of the cover housing 3, while a platen roller is provided on the side of a main housing 2.

At the front end of the cover housing 3, an attaching part 3*c* which protrude on the side of the main housing 2 is formed and a thermal head 8 is attached to a part on the front side of the attaching part 3*c*. The thermal head 8 is attached in a state in which the head face is tilted from a perpendicular direction on the front side of the main housing 2 when the cover housing 3 is closed and, hereby, comes into contact with the platen roller 9 arranged in a predetermined part of the main housing 2 from a diagonally upper direction.

For the platen roller 9 in this embodiment, a gear 10 is fixed to a platen shaft 9*a* shown in FIG. 1 as in the above embodiments. A driving motor 32 is provided inside the main housing 2 and a driving mechanism 34 for rotating the platen roller 9 is constituted by transmitting the driving force of the driving motor 32 to the above gear 10 via a driving transmission mechanism 33.

At the front end of the ma in housing 2, a guide member 2*b* curved toward the platen roller 9 is formed. The guide member 2*b* is provided to guide the released pasteboard 11 of label paper 7 to the front of the main housing 2.

In this embodiment, the above guide member 14A shown in FIG. 3 is attached on the side of the cover housing 3. That is, the arm 16A of the guide member 14A is attached to both sides of the end of the attaching part 3*c* of the cover housing 3 so that the arm can be turned around a pivot 15.

The guide member 14A is constituted so that the pressing roller 17 can be turned between a position (a standby position) shown by an alternate long and two short dashes line in FIG. 5(*b*) and over the attaching part 3*c* of the cover housing 3 and a position (a separating position) shown by a solid line and pressed upon the platen roller 9.

In this embodiment provided with such constitution, when a label 12 is stuck on the radially inner side of the rolled label paper 71, and rolled label paper 71 is set and printing is performed, the pressing roller 17 of the guide member 14A is moved to the standby position shown by the alternate long and two short dashes line in FIG. 5(*b*), and then the cover housing 3 is opened and the label paper 71 is loaded into the supporting part 3*a*. Next, the cover housing 3 is closed with the end of the pasteboard 11 pulled out upward.

As shown by the solid line in FIG. 5(*b*), the pressing roller 17 of the guide member 14A is rotated to the separating position and the pasteboard 11 of the label paper 71 is pressed upon the platen roller 9.

Afterward, the pasteboard 11 and the label 12 are separated by driving the thermal head 8, rotating the platen roller 9 clockwise (in a direction shown by an arrow D) in FIG. 5(*b*) and carrying the label paper 71 in the same direction and performing predetermined printing on the label 12 as in the above embodiments.

By such operation, the printed label 12 is ejected through an ejection port 18 in a direction shown by an arrow E, while the pasteboard 11 can be ejected in a direction shown by an arrow F above the main housing 2.

As described above, according to this embodiment, since the platen roller 9 and the driving mechanism 34 are provided inside the main housing 2, driving force can be applied to the platen roller 9, always holding the platen roller 9 and the driving mechanism 34 in the same positional relationship. As a result, according to this embodiment, the platen roller 9 can be always stably driven and recording paper can be precisely fed.

Also, in this embodiment, since opening and closing of the cover housing 3 has no effect upon a driving transmission member such as a gear of the driving mechanism 34, a gear and others are not worn and recording paper can be precisely fed in a long term.

In this embodiment, so-called "involute label paper" 71 in which the label 12 is stuck to the inner side of the pasteboard 11 is used, however, if as in the embodiment shown in FIG. 2(*b*), so-called "revolute label paper" 7 in which the label 12 is stuck to the outer side the pasteboard 11 is used, the label paper 7 has only to be loaded in a different direction so that the label 12 is opposite to the thermal head 8. As the other constitution, action and effect are the same as in the above embodiments, the detailed description is omitted.

Fifth Embodiment

Figure 6:
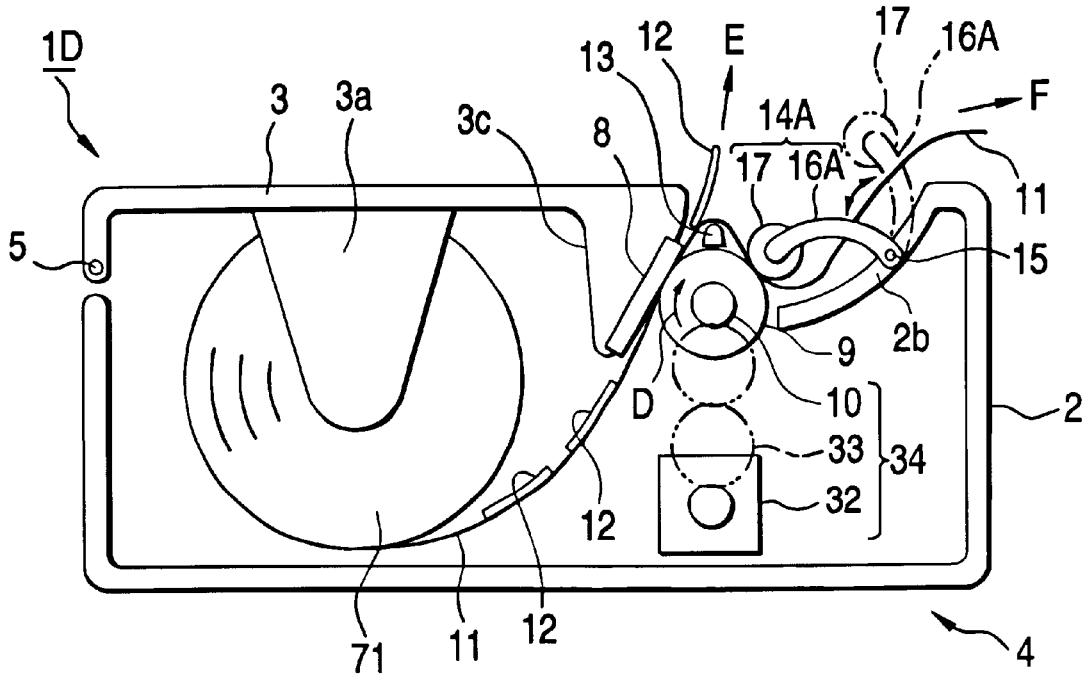
FIG. 6 is a schematic drawing showing the internal constitution of a fifth embodiment of the present invention in setting the label paper with the cover housing closed.
Figure 7:
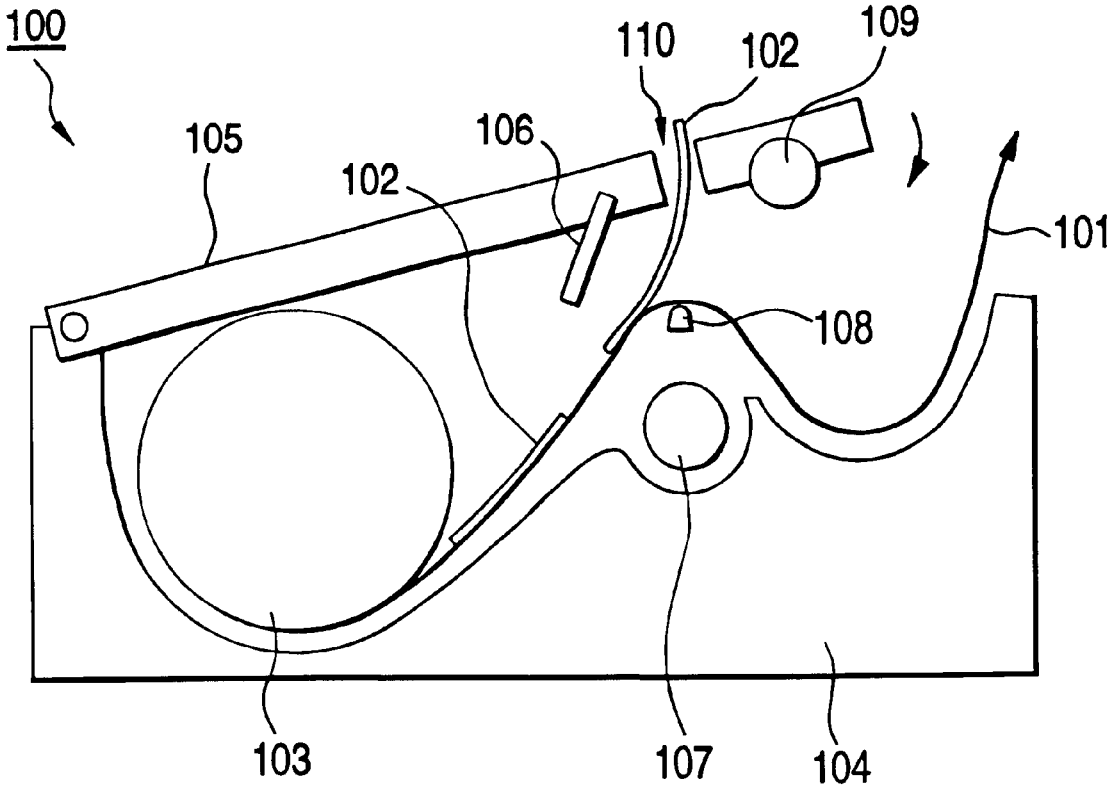
FIG. 7 (PRIOR ART)
FIG. 7 is a schematic drawing showing the internal constitution of a conventional type printer for issuing a label.

FIG. 6 is a schematic drawing showing the internal constitution of a fifth embodiment of the printer according to the present invention and shows a state in which a second printer housing is closed in case label paper is set. The same reference numbers are used to denote parts corresponding to those in the above embodiments and the description is omitted.

As shown in FIG. 6, a printer 1D according to this embodiment is different from the printer 1C according to the fourth embodiment shown in FIGS. 5 in that a guide member 14A is provided on the side of a main housing 2.

That is, in this embodiment, the arm 16A of the guide member 14A is attached to both sides of the guide member 2*b* of the main housing 2 so that the arm can be turned around a pivot 15.

The guide member 14A is so constituted that the pressing roller 17 can be turned between a position (a standby position) shown by an alternate long and two short dashes line in FIG. 6 and over the guide member 2*b* of the main housing 2 and a position (a separating position) shown by a solid line and pressed upon a platen roller 9 in a state in which the cover housing 3 is closed.

According to this embodiment provided with such constitution, as in the fourth embodiment, the platen roller 9 can be always stably driven and recording paper can be precisely fed in a long term without wearing a gear and others. As the other constitution, action and effect are the same as in the above embodiments, the detailed description is omitted.

The present invention is not limited to the above embodiments and various variations are possible.

For example, in the above embodiments, the guide member is constituted so that it can be turned between the standby position and the separating position, however, the present invention is not limited to this and the guide member may be also constituted so that it is slid between the standby position and the separating position. Moreover, the guide member can be even fixed to either the cover housing or main housing. Further, the guide member can be equipped with a sliding member with low friction coefficient material attached thereon instead of the pressing roller 17.

The shape, the size and others of the pressing roller, the arm and others constituting the guide member may be suitably changed according to a position in which the separator is provided and others.

Further, the detector in the third embodiment may be also a transmission sensor between the first printer housing and the second printer housing.

Furthermore, the present invention is not limited to the thermal printer and can be also applied to an impact dot printer and an ink-jet printer for example. However, if the present invention is applied to the thermal printer as in the above embodiments, a small-sized and light weight printer can be obtained.

Furthermore, if a storing part is provided to the main housing 2 so that the whole guide member can be stored or retracted in the main housing when the guide member is located in the standby position in the second and third embodiments, the visibility of the printout is enhanced and the commercial value of the printer is enhanced.

Furthermore, the example that the driving motor 20 is used for the driving mechanism 19 for turning the guide member 14B is described above, however, the driving mechanism maybe also operated using a solenoid.

As described above, according to the present invention, in the printer which can print on plain paper and label paper, plain paper can be extremely readily set and the operability of the printer can enhanced.

What is claimed is:

1. A printer comprising a main body;

a printing head;

an elongated platen;

a guide member;

a first body member connected with respect to said main body, supporting one of said printing head and said platen, and moveable between a first position with said printing head opposing and adjacent to said platen, and a second position with said printing head spaced away from said platen;

a second body member connected with respect to said main body, supporting said guide member, and moveable between a third position with said guide member adjacent and parallel to said platen, and a fourth position with said guide member spaced away from said platen;

wherein said first and second body members are relatively closer to each other when in said first and third positions respectively, and relatively farther from each other when in said second and fourth positions respectively.

2. The printer of claim 1 wherein said first and second body members are pivotably attached with respect to said main body.

3. The printer of claim 2 wherein said first body member is pivotably supported about a first axis, said second body member is pivotably supported about a second axis, and said body members pivot in opposite directions when moving away from the positions in which they are relatively closest to each other.

4. The printer of claim 1 wherein said platen and said guide member are rollers.

5. The printer of claim 1 wherein said printing head is supported by said first body member.

6. The printer of claim 1 wherein said platen is supported by said first body member.

7. The printer of claim 1 wherein said printing head is a thermal printing head.

8. The printer of claim 1 further comprising a printing medium path within said main body and a label detector within said main body, adjacent to said printing medium path.

9. The printer of claim 8 further comprising a motor mechanically coupled to move said second body member between said third and fourth positions.

10. The printer of claim 9 wherein said motor moves said second body member in response to a signal generated by said label detector.

11. The printer of claim 1 wherein said printer further comprises an outer housing, and said first and second body members form portions of said outer housing.

12. The printer of claim 1, further comprising a spring urging said guide member against said platen when said first body member is in said first position.

13. A printer having a separator for removing printed labels from a base sheet comprising a main body;

a printing medium holder within said main body;

a printing head;

an elongated platen;

a guide roller;

a first body member pivotably connected with respect to said main body, supporting one of said printing head and said platen, and moveable between a first position with said printing head opposing and adjacent to said platen, and a second position with said printing head spaced away from said platen;

a second body member pivotably connected with respect to said main body, supporting said guide roller, and moveable between a third position with said guide roller adjacent and parallel to said platen, and a fourth position with said guide roller spaced away from said platen;

wherein said first and second body members are relatively closer to each other when in said first and third positions respectively, and relatively farther from each other when in said second and fourth positions respectively; and wherein the axis of said movement of said first body member is parallel to the axis of said movement of said second body member, and said body members pivot about their respective axes in opposite directions when moving away from the positions in which they are relatively closer to each other.

14. The printer of claim 13 wherein an S-curved base sheet path is formed between said platen and said printing head, then over said guide roller and then between said platen and said guide roller when said first and second body members are in said first and third positions respectively.

15. The printer of claim 13, further comprising a spring urging said guide roller against said platen when said first body member is in said first position.

* * * * *

UNITED STATES PATENT AND TRADEMARK OFFICE

CERTIFICATE OF CORRECTION

PATENT NO. : 6,505,981 B1
DATED : January 14, 2003
INVENTOR(S) : Takami et al.

It is certified that error appears in the above-identified patent and that said Letters Patent is hereby corrected as shown below:

Title page,
Please insert:
-- [30] Foreign Application Priority Data
October 9, 1997 [JP] P. Hei. 9-277267. --

Signed and Sealed this

Fifteenth Day of July, 2003

JAMES E. ROGAN
*Director of the United States Patent and Trademark Office*